US007867571B2

(12) United States Patent
Hubner et al.

(10) Patent No.: US 7,867,571 B2
(45) Date of Patent: Jan. 11, 2011

(54) TEXTILE SURFACE

(75) Inventors: Hans-Jurgen Hubner, Brione S.M. (CH); Roland Lottenbach, Wolfhalden (CH)

(73) Assignee: Schoeller Textil AG, Sevelen (CH)

( * ) Notice: Subject to any disclaimer, the term of this patent is extended or adjusted under 35 U.S.C. 154(b) by 224 days.

(21) Appl. No.: 11/618,680

(22) Filed: Dec. 29, 2006

(65) Prior Publication Data

US 2007/0151039 A1 Jul. 5, 2007

Related U.S. Application Data

(63) Continuation of application No. 10/432,854, filed on May 28, 2003, now abandoned.

(30) Foreign Application Priority Data

Feb. 2, 2001 (DE) ..... 101 05 234
Jan. 21, 2002 (WO) ..... PCT/EP02/00539

(51) Int. Cl.
*B05D 3/02* (2006.01)

(52) U.S. Cl. ..... 427/385.5; 427/387; 427/389.9; 427/394; 427/421.1; 427/427.4; 427/428.01; 427/428.14; 427/430.1

(58) Field of Classification Search ..... None
See application file for complete search history.

(56) References Cited

U.S. PATENT DOCUMENTS 4,454,191 A * 6/1984 von Blucher et al. ..... 442/224
5,885,656 A * 3/1999 Goldwasser ..... 427/282
6,187,391 B1 * 2/2001 Kataoka et al. ..... 427/569

FOREIGN PATENT DOCUMENTS

JP 50-033199 B * 10/1975
JP 56/144272 11/1981
JP 58/197378 11/1983
JP 59-106570 * 6/1984
JP 60-224871 * 11/1985

(Continued)

OTHER PUBLICATIONS

Abstracts and translation of JP 58-191275, Nov. 1983.*

(Continued)

*Primary Examiner*—Erma Cameron
(74) *Attorney, Agent, or Firm*—Janet Sleath; Speckman Law Group PLLC

(57) ABSTRACT

The aim of the invention is to produce a textile surface (1), one side of which exhibits hydrophilic properties and the other side hydrophobic properties, whose overall cross-section is hydrophilic. To achieve this, a paste (11) consisting of a viscous emulsion or dispersion of paraffin, polysiloxane and/or fluorine compounds is applied to one side. The layer that has been formed by the first paste (11) is then stabilized by means of a drying process (4) and a second paste (12), consisting of a hydrophilic polymer is subsequently applied to the other side of the textile surface (1), said paste being stabilized by an additional drying process (5). Said steps provide a textile surface (1), which can be produced simply and cost-effectively, is extremely comfortable to wear and which ensures that moisture is immediately absorbed on the hydrophilic side, dispersed over a large area and rapidly removed, whereas the hydrophobic side of said textile surface (1) repels water.

13 Claims, 4 Drawing Sheets

FOREIGN PATENT DOCUMENTS

| | | | | |
|---|---|---|---|---|
| JP | 61-113879 | | * | 5/1986 |
| JP | 01-53394 | B2 | | 3/1989 |
| JP | 01053391 | A | | 3/1989 |
| JP | 01053394 | B | | 11/1989 |
| JP | 03-027181 | | | 2/1991 |
| JP | 06-123086 | | * | 5/1994 |
| JP | 06123086 | A | | 5/1994 |
| JP | 06-173171 | | * | 6/1994 |
| JP | 06173171 | A | | 6/1994 |
| JP | 7189130 | | | 7/1995 |
| JP | 07189130 | A | | 7/1995 |
| JP | 10-18182 | | * | 1/1998 |
| JP | 10018182 | A | | 1/1998 |
| JP | 04970269 | A | | 2/2001 |
| WO | WO 95/34609 | | * | 12/1995 |
| WO | 96/02555 | A1 | | 8/1996 |

OTHER PUBLICATIONS

Abstract and translation of JP 04-370269, Dec. 1992.*
Abstract and translation of JP 58-191275, Nov. 1983.*

* cited by examiner

TEXTILE SURFACE

CROSS REFERENCE TO RELATED APPLICATIONS

This application is a continuation of U.S. patent application Ser. No. 10/432,854, filed May 28, 2003 now abandoned, which claims to International Patent Application No. PCT/EP02/00539, filed Jan. 21, 2002, which claims priority to German Patent Application No. DE 101 05 234.0, filed Feb. 2, 2001.

FIELD OF THE INVENTION

The present invention relates to a process for manufacturing a textile surface with hydrophobic properties on one side and hydrophilic properties on the other, devices for utilising this process as well as application substances with which the textile surface is to be treated in accordance with the process and the devices.

BACKGROUND OF THE INVENTION

Textile surfaces having the aforementioned properties are already known. In these textile surfaces of prior art, the hydrophobic area of a textile surface is separated from its hydrophilic area by means of a differently configured membrane located in between the two fabrics and in a fixed connection with the fabrics. Since several production processes are involved, the manufacture of such kinds of textile surface is very timely and cost-intensive. In addition, the textile surface is very rigid as a result of the membrane which is usually bonded to both fabrics, and as a result there are often also difficulties with regard to processing the textile surface and the range of applications for the textile surface is restricted. Furthermore, it is disadvantageous that having the membrane as an intermediate layer in an article of clothing restricts the transport of moisture from the inside to the outside, while the garment is made bulky as a result of the thickness of the material.

The purpose of the present invention is therefore to create a textile surface which can be manufactured in a very straightforward and economical fashion by means of special processes and/or devices and due to the application substances involved in these processes and/or devices, the textile surface offering a high degree of comfort to the wearer and in which, above all, it is assured that moisture will be immediately absorbed on the hydrophilically treated side, distributed over a wide area and rapidly taken away, while the hydrophobically treated side is water-repellent. The processes by means of which this is achieved, as well as the devices for utilising this process are intended to make this possible without difficulty and be of a straightforward design, while the application substances also should only be composed of a few conventional constituents with the result that textile surfaces with very different structures can be manufactured inexpensively.

SUMMARY OF THE INVENTION

A process for manufacturing a textile surface with hydrophobic properties on one side and hydrophilic properties on the other is characterised in that the textile surface is hydrophilic across its complete cross-section, that a paste is applied to one side of the textile surface in a continuous process, this paste comprising a emulsion or dispersion of paraffin, polysiloxane and/or fluorine compounds, and that the layer formed by the paste is then stabilised in a drying process.

In accordance with another process, a first paste is once again continuously applied to one side of the textile surface, the paste comprising a emulsion or dispersion of paraffin, polysiloxane and/or fluorine compounds, after which the coat formed by the paste is stabilised in a drying process, then a second paste comprising hydrophilic polymers is applied to the other side of the textile surface which is stabilised in another drying process. It goes without saying that in this process it is also possible to apply the second paste to the textile surface first, followed by the first paste.

Another process for manufacturing a textile surface of the aforementioned kind in accordance with the present invention is characterised in that a paste is once again continuously applied to one side of the textile surface, the paste comprising a emulsion or dispersion of paraffin, polysiloxane and/or fluorine compounds, that after this the coat formed by the paste is stabilised in a drying process, and that then, however, a liquor comprising hydrophilic polymers is applied to the other side of the textile surface and is stabilised in a further drying process in order to create the side of the textile surface with hydrophilic properties, in which case the liquor can be applied to the textile surface by means of a soaking bath, an applicator roll or a spray head.

In this process too, it is possible to apply the liquor to the textile surface first and then the paste, and if necessary to apply the emulsion or dispersion of paraffin, polysiloxane and/or fluorine compounds as a liquor and to apply the hydrophilic polymers to the textile surface in the form of a paste.

In each case, the pastes are to be applied to the textile surface using a coating doctor blade.

During the drying process, the textile surface should be exposed to a temperature of 80 to 200.degree. C.

The devices for utilising these processes should be characterised in that a coating doctor blade is used for applying a paste comprising a emulsion or dispersion of paraffin, polysiloxane and/or fluorine compounds or a paste comprising hydrophilic polymers, while a soaking bath through which the textile surface is passed, an applicator roll revolving in a trough holding the liquor or a spray head is used for applying a liquor comprising an emulsion or dispersion of paraffin, polysiloxane and/or fluorine compounds or a liquor comprising hydrophilic polymers, and in the case of the soaking bath, the textile surface should be passed through one or more pairs of pressure rolls after immersion.

The hydrophobically acting pastes which can be used as application substances should consist of 2 to 100 parts paraffin emulsion containing zircon salt or of 2 to 10 parts polysiloxane emulsion and 98 to 0 parts water and synthetic or natural thickening agent with a viscosity of 2000 to 15,000 mPa·s, or of 2 to 100 parts emulsion or dispersion of fluorine compounds or fluoropolymers, 98 to 0 parts water and 1 to 10 parts synthetic or natural thickening agent with a viscosity of 2000 to 15,000 mPa·s, or the paste should consist of a modified fluorocarbon with a solid matter content of 2.4% and having a viscosity of 5000 to 10,000 mPa·s.

The hydrophobically acting liquor to be utilised in the same way can consist of 1 to 100 parts paraffin emulsion containing zircon salt or of 1 to 100 parts polysiloxane emulsion and 99 to 0 parts water, although it is also possible to manufacture the liquor from 2 to 100 parts dispersion of hydrophilic polymers, 98 to 100 parts water and synthetic or natural thickening agent with a viscosity of 2000 to 15,000 mPa·s.

In accordance with another recipe, the hydrophilically acting liquor can also consist of 1 to 100 parts dispersion of hydrophilic polymers and 99 to 0 parts water.

Furthermore, it is appropriate for the hydrophobically acting paste to be applied to the textile surface at a rate of 30 to 100 g/m.sup.2 at a temperature of approx. 140 to 170.degree. C. and within a contact time of at least 1 minute and for the hydrophilically acting paste to be applied to the textile surface at a rate of 30 to 100 g/m.sup.2 at a temperature of approx. 140 to 170.degree. C. and within a contact time of at least 10 seconds.

By utilising the processes and devices in accordance with the present invention as well as the application substances provided for in the present invention, it is possible to create a textile surface from only one layer of fabric which offers extraordinarily good hydrophobic and hydrophilic properties, and can as a result be used in a wide range of applications. This is because the hydrophobically acting application substance applied to the textile surface in a defined fashion supplies the precondition for the remaining area of the textile surface to be provided with hydrophilic characteristics, with the result that both areas fulfil the very different functions specified.

An article of clothing with a hydrophobic exterior therefore offers protection to the wearer in the rain, when walking through wet grass, while this side is also less susceptible to dirt and easier to clean. On the other hand, the hydrophilic interior of the garment absorbs a large quantity of moisture within a short period of time, which is then distributed over a wide area and can escape via the outer side. Consequently, an article of clothing manufactured from a textile surface produced in accordance with the present invention is very comfortable to wear.

The production complexity involved in impregnating textile surfaces using the processes and devices in accordance with the present invention as well as the application substances provided for in the present invention is very low, which means they can be treated in an inexpensive fashion. Furthermore, the textile surfaces can easily be adapted to suit the particular application, in particular with regard to the material thickness, and as a result a very wide range of applications is made possible.

DETAILED DESCRIPTION OF THE INVENTION

Figure 1:
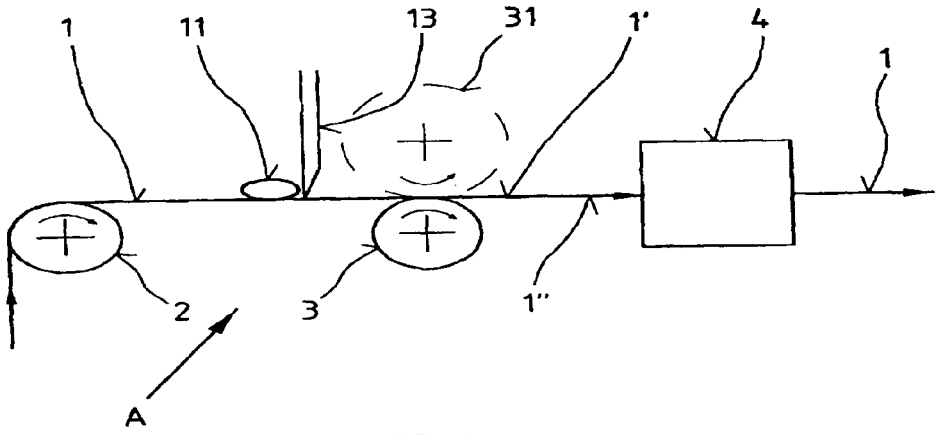
FIG. 1 shows a device for applying a paste to one side of a textile surface with hydrophilic properties.

The devices displayed in FIGS. 1 to 8 and identified in each case by A, B, C or D serve to apply a hydrophobically acting paste 11 or a hydrophilically acting paste 12 and a hydrophobically acting liquor 21 or a hydrophilically acting liquor 22 to a textile surface 1 and the aforementioned devices are configured differently from one another.

Figure 2:
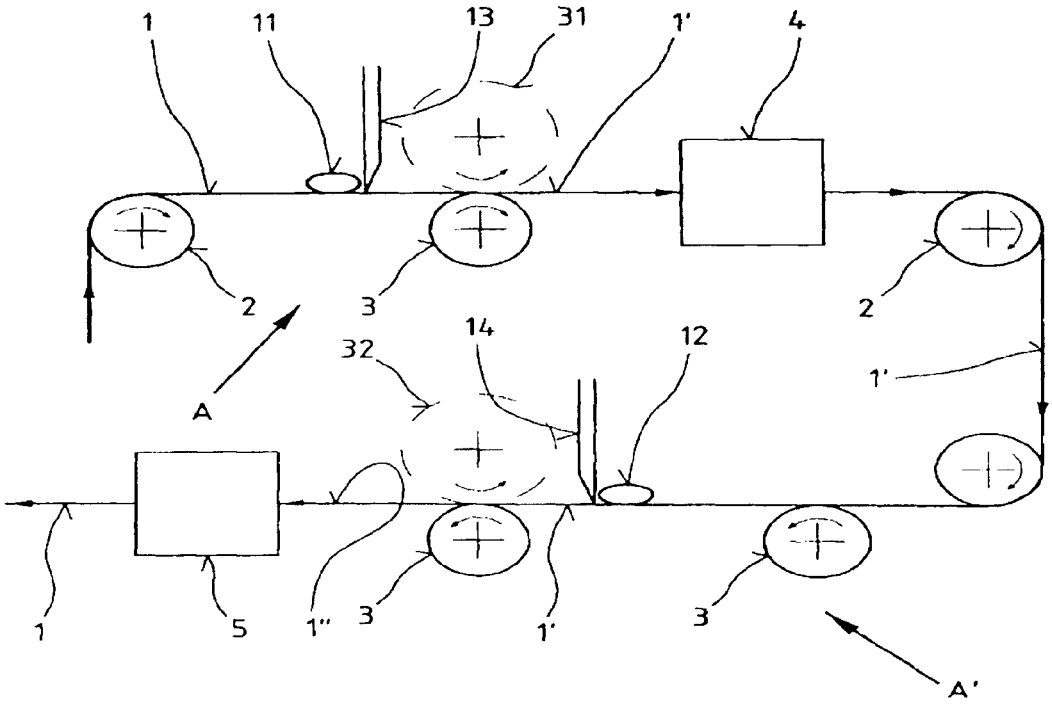
FIG. 2 shows the device in accordance with FIG. 1 followed by a second device for applying a second paste to the other side of the textile surface.

The devices A in accordance with FIG. 1 or A, A' in accordance with FIG. 2 each comprise reversing rollers 2 and contact rollers 3 by means of which the hydrophilic textile surface 1 is guided, coating doctor blades 13 or 14 as well as a dryer 4 or two dryers 4 and 5 following the coating doctor blades 13 or 14. By means of device A in accordance with FIG. 1, the hydrophobically acting paste 11 is applied to one side of the hydrophilic textile surface 1 using a coating doctor blade 13, this hydrophobically acting paste 11 penetrates part of the way into the textile surface 1 and is stabilised in the dryer 4. The side of the textile surface identified by 1' is therefore hydrophobic while the other side 1" remains hydrophilic.

With the help of device A', which as shown in FIG. 2 is connected following device A and is configured in the same manner, the coating doctor blade 14 is used to apply a hydrophilically acting paste 12 to the side 1" of the textile surface, this hydrophilically acting paste 12 being stabilised in the dryer 5. As a result, the textile surface 1 has a hydrophobically acting side 1' and a hydrophilically acting side 1".

Figure 3:
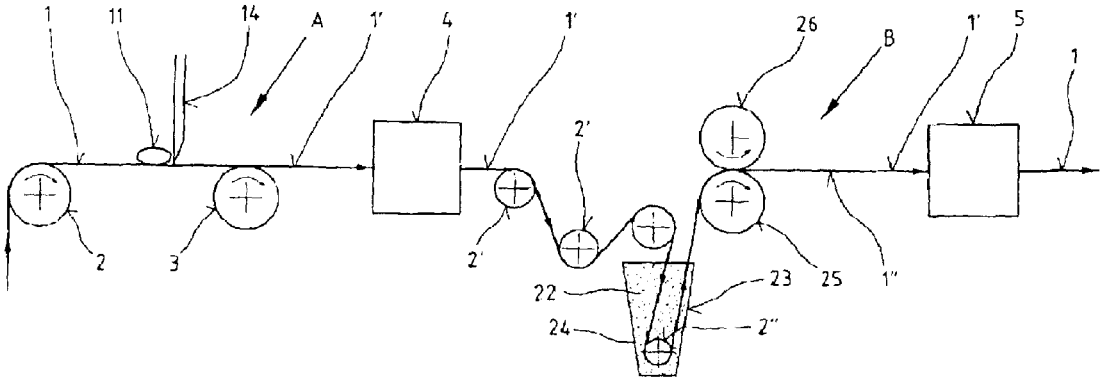
FIGS. 3, 4 and 5 show the device in accordance with FIG. 1 followed by devices provided with a soaking bath or and applicator roll or a spray head

In accordance with FIG. 3, device A has a device B assigned to it, which is equipped with a soaking bath 23 provided with reversing rollers 2' and 2". For this purpose, a trough 24 is filled with the liquor 22 which has a hydrophilic effect and through which is passed the textile surface 1 by means of the reversing roller 2" arranged in the soaking bath 23. In the dryer 5, the liquor 22 is stabilised in the area of the textile surface 1 which was not impregnated with the paste 11, so that the textile surface 1 once again possesses a hydrophobically acting side 1' and a hydrophilically acting side 1".

In order to reduce the amount of energy consumed by the dryer 5, the soaking bath 23 is followed by a pair of pressure rolls 25, 26 through which the textile surface 1 is drawn. The pair of pressure rolls 25, 26 therefore significantly reduces the moisture content of the textile surface 1.

Figure 4:
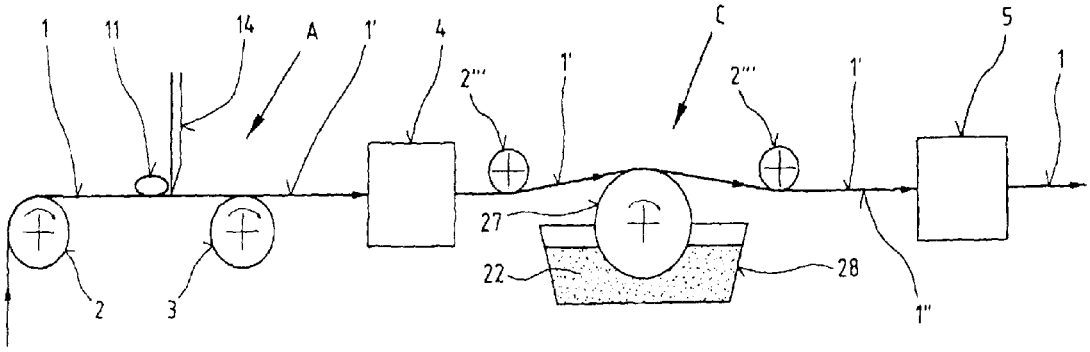

In accordance with FIG. 4, an applicator roll 27 is used to apply the liquor 22 held in a trough 28 to the textile surface 1. In this process, two tensioning rollers 2'" keep the textile surface 1 pressed against the applicator roll 27 which picks up the liquor 22, with the result that the liquor 22 is transferred onto the textile surface 1. In the dryer 5, the absorbed hydrophilically acting liquor 22 is stabilised in the area of the textile surface 1 which was not impregnated with the paste 11, so that the side 1' of the textile surface 1 is hydrophobic whereas the side 1" is hydrophilic.

Figure 5:
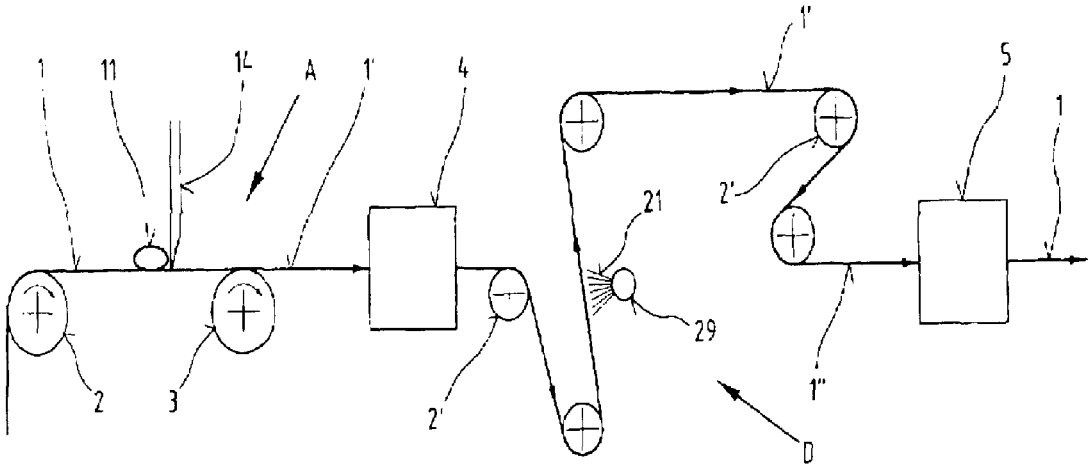

However, as shown in FIG. 5, the liquor 22 can also be sprayed onto the textile surface 1. A spray head in device D is used for this purpose, by means of which the liquor 22 is applied to the textile surface 1 in order to produce its hydrophilic side 1".

Figure 6:
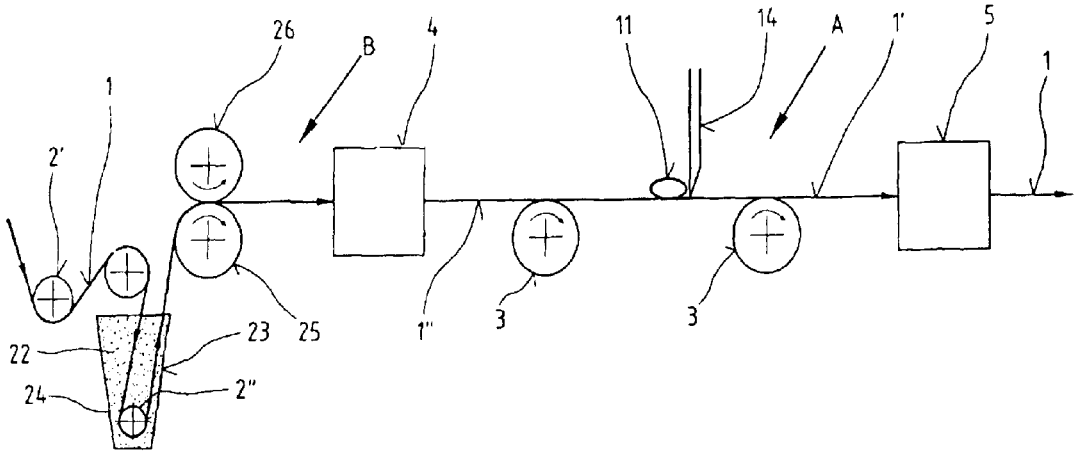
FIGS. 6, 7 and 8 show the devices in accordance with FIGS. 3, 4 and 5, in each case followed by a device in accordance with FIG. 1.
Figure 7:
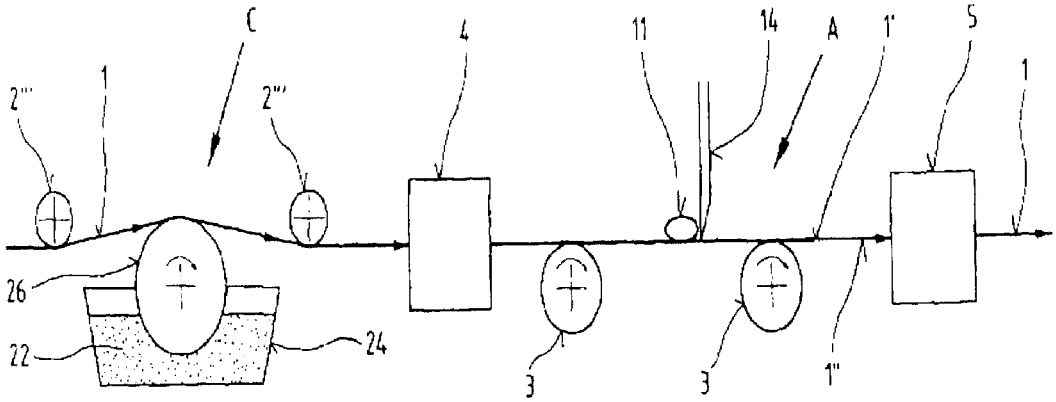
Figure 8:
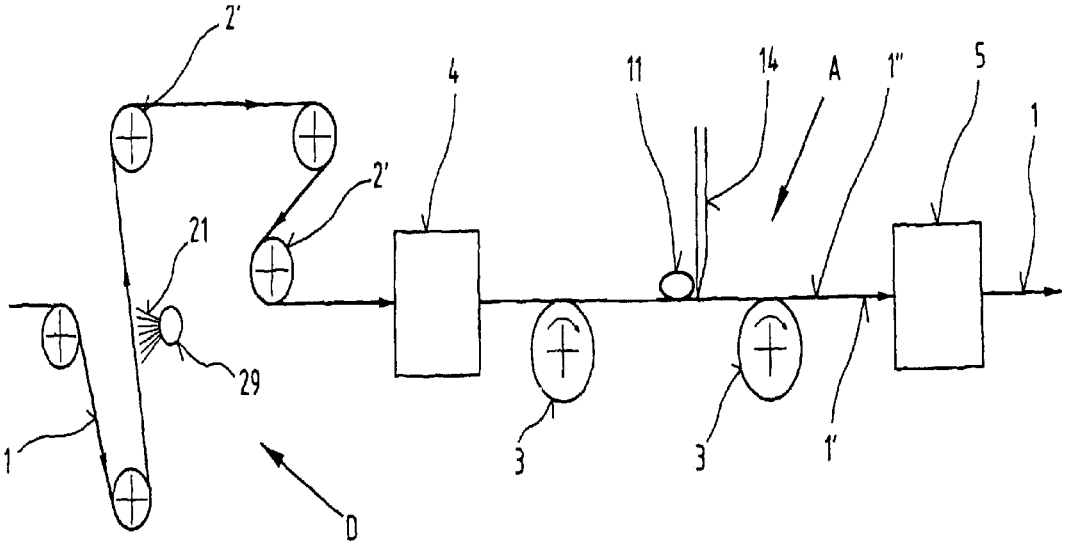

In accordance with FIGS. 6, 7 and 8, device A is preceded in each case by devices B, C and D. In accordance with FIG. 6, the soaking bath 23 applies the hydrophilically acting liquor 22 to the textile surface 1, while the hydrophobically acting paste 11 makes side 1' of the textile surface hydrophobic. The combination of devices C and A shown in FIG. 7 acts in the same manner.

It goes without saying, however, that the soaking bath 23 or the applicator roll 27 can be used for applying a hydrophobically acting liquor 21 to the textile surface 1, and in this case the subsequently applied hydrophilic paste 12 creates a hydrophilic film which absorbs moisture and distributes it over a wide area.

Device D in FIG. 8 sprays the hydrophobically acting liquor 21 onto the textile surface in such a way that it only penetrates a partial area of the textile surface. As a result, the hydrophilically acting paste 12 only influences that part of the textile surface 1 which is not hydrophobic, with the result that the textile surface 1 once again has a hydrophobically acting side 1' and a hydrophilically acting side 1".

EXAMPLES OF APPLICATION SUBSTANCES

Example 1

1. 10 to 30 parts paraffin emulsion containing zircon salt, 90 to 70 parts water, 1 to 5 parts synthetic thickening agent, for example a water soluble polymer dispersion containing isoparaffin, or natural thickening agent, for example hydroxyethylcellulose; viscosity of the paste 5000 to 10,000 mPa·s, solid matter content 2.5%.

2. 10 to 30 parts polysiloxane emulsion, 90 to 70 parts water, 1 to 5 parts synthetic thickening agent, for example a water soluble polymer dispersion containing isoparaffin, or natural thickening agent, for example hydroxyethylcellulose; viscosity of the paste 5000 to 10,000 mPA·s, solid matter content 2.5%.

Example 2

5 to 30 parts emulsion or dispersion of fluorine compounds or fluoropolymers, 95 to 70 parts water, 1 to 5 parts synthetic thickening agent, for example a water soluble polymer dispersion containing isoparaffin, or natural thickening agent, for example hydroxyethylcellulose; viscosity of the paste 5000 to 10,000 mPa·s, solid matter content 1 to 4%.

Example 3

100 parts compound made from a modified fluorocarbon; viscosity of the paste 5000 to 10,000 mPa·s, solid matter content 2 to 4%.

Example 4

1. 1 to 10 parts paraffin emulsion containing zircon salt, 99 to 90 parts water;

2. 1 to 10 parts polysiloxane emulsion, 99 to 90 parts water;

3. 1 to 10 parts emulsion or dispersion of fluorine compounds or fluoropolymers, 99 to 90 parts water.

Example 5

5 to 30 parts hydrophilic polymer, solid matter content approx. 20%, 95 to 70 parts water, 1 to 5 parts synthetic thickening agent, for example a water soluble polymer dispersion containing isoparaffin, or natural thickening agent, for example hydroxyethylcellulose; viscosity of the paste 5000 to 10,000 mPa·s, solid matter content 1 to 6%.

Example 6

1 to 20 parts hydrophilic polymer, solid matter content approx. 20%, 99 to 80 parts water.

We claim:

1. A process for manufacturing a textile surface having hydrophobic properties on a first side of the textile surface and hydrophilic properties on a second side of the textile surface, comprising:

continuously applying an emulsion or dispersion comprising at least one component selected from the group consisting of: paraffin, polysiloxane and fluorine compounds, and 1 to 5 parts of a synthetic thickening agent or a natural thickening agent to the first side of the textile surface to form a first coating wherein the emulsion or dispersion is applied to the textile surface as a paste with a viscosity of 5,000 to 10,000 mPa·s, stabilizing the first coating in a first drying process, applying a composition comprising hydrophilic polymers to the second side of the textile surface to form a second coating, and stabilizing the second coating in a second drying process, wherein the textile surface is hydrophilic across its complete cross-section.

2. The process according to claim 1, wherein the composition comprising hydrophilic polymers is a liquor and comprises 1 to 100 parts dispersion of hydrophilic polymers and 99 to 0 parts water.

3. The process according to claim 1, wherein the composition comprising hydrophilic polymers is applied to the textile surface as a liquor.

4. The process according to claim 3, wherein the liquor is applied to the textile surface using a soaking bath, an applicator roll, or a spray head.

5. The process according to claim 4, wherein the textile surface is passed through at least one pair of pressure rolls after the textile surface is immersed in the soaking bath.

6. The process according to claim 3, wherein a coating doctor blade is used to apply the paste to the textile surface.

7. The process according to claim 3, wherein the paste comprises 2 to 100 parts of emulsion or dispersion of fluorine compounds.

8. The process according to claim 3, wherein the paste comprises 2 to 100 parts of emulsion or dispersion of fluoropolymers; 98 to 0 parts water; and wherein the thickening agent has a viscosity between about 2000 mPa·s and about 15,000 mPa·s.

9. The process according to claim 3, wherein the paste comprises a fluorocarbon having a solid matter content of 2.4% and a viscosity between about 5000 mPa·s and about 10,000 mPa·s.

10. The process according to claim 3, wherein the paste is applied to the textile surface at a rate between about 30 $g/m^2$ and about 100 $g/m^2$ and at a temperature between about 140° C. and about 170° C., and wherein the paste is in contact with the textile surface for at least 1 minute.

11. The process according to claim 1, wherein the textile surface is exposed to a temperature between about 80° C. and about 200° C. during the first and second drying processes.

12. The process according to claim 1, wherein the fluorine compound is a fluoropolymer.

13. The process according to claim 1, wherein the fluorine compound is a fluorocarbon.

* * * * *